US009297172B2

(12) United States Patent
Buitendijk

(10) Patent No.: US 9,297,172 B2
(45) Date of Patent: Mar. 29, 2016

(54) SCAFFOLD WITH HANDRAIL FRAMES PROVIDED WITH POST SECTIONS

(75) Inventor: Dick Buitendijk, Nuenen (NL)

(73) Assignee: XS Platforms Holding B.V., Gorinchen (NL)

( * ) Notice: Subject to any disclaimer, the term of this patent is extended or adjusted under 35 U.S.C. 154(b) by 1432 days.

(21) Appl. No.: 12/531,846

(22) PCT Filed: Mar. 19, 2008

(86) PCT No.: PCT/NL2008/050156

§ 371 (c)(1),
(2), (4) Date: Feb. 1, 2010

(87) PCT Pub. No.: WO2008/115059

PCT Pub. Date: Sep. 25, 2008

(65) Prior Publication Data

US 2010/0140018 A1 Jun. 10, 2010

(30) Foreign Application Priority Data

Mar. 19, 2007 (NL) ..... 2000547

(51) Int. Cl.

| | |
|---|---|
| ***E04G 1/14*** | (2006.01) |
| ***E04G 1/15*** | (2006.01) |
| ***E04G 5/12*** | (2006.01) |
| ***E04G 1/20*** | (2006.01) |

(52) U.S. Cl.

CPC .. *E04G 1/14* (2013.01); *E04G 1/15* (2013.01); *E04G 1/20* (2013.01); *E04G 5/12* (2013.01)

(58) Field of Classification Search

CPC ..... E04G 1/14

USPC ..... 182/178.1, 178.5, 178.6

See application file for complete search history.

(56) References Cited

U.S. PATENT DOCUMENTS

| | | | | | |
|---|---|---|---|---|---|
| 2,316,952 | A | * | 4/1943 | Halferty | 182/178.6 |
| 2,379,446 | A | * | 7/1945 | Krueger | 182/178.1 |
| 2,815,130 | A | * | 12/1957 | Franks | 211/191 |
| 2,829,929 | A | * | 4/1958 | Wardell | 182/13 |
| 2,833,596 | A | * | 5/1958 | Borgman et al. | 182/132 |
| 3,486,579 | A | * | 12/1969 | Blomgren | 182/178.1 |
| 3,498,016 | A | * | 3/1970 | Nowak | 52/638 |
| 4,703,702 | A | * | 11/1987 | Speicher | 108/56.3 |
| 4,773,506 | A | * | 9/1988 | Preston | 182/152 |

(Continued)

FOREIGN PATENT DOCUMENTS

| | | |
|---|---|---|
| FR | 1164723 | 10/1958 |
| FR | 1178736 | 5/1959 |
| FR | 1188571 | 9/1959 |

*Primary Examiner* — Colleen M Chavchavadze

(74) *Attorney, Agent, or Firm* — Eric Karich; Karich & Associates

(57) ABSTRACT

A scaffold has several spaced apart systems of construction frames present on top of each other, as well as handrail frames that extend between the construction frames. The construction frames have three posts connected together by crossbars, in which the front post is shorter than the other two. The handrail frames are attached to these short posts. Each handrail frame is built up of two post sections with a handrail and a side plank between them. The post sections form half of a lengthwise divided post. The post sections of two adjacent handrail frames thus form one whole post, which can be inserted into the short post of a construction frame. As the post sections are part of the handrail frames, the handrail frames can be easily attached to the short posts already present at the front of the construction frames.

9 Claims, 2 Drawing Sheets

(56) References Cited

U.S. PATENT DOCUMENTS

| | | | | |
|---|---|---|---|---|
| 4,891,926 | A * | 1/1990 | Allenbaugh | 52/637 |
| 5,127,492 | A * | 7/1992 | Preston | 182/152 |
| 5,135,077 | A * | 8/1992 | Shalders | 182/82 |
| 5,233,707 | A * | 8/1993 | Perkins | 5/8 |
| 6,220,391 | B1 * | 4/2001 | White | 182/178.5 |
| 6,422,345 | B1 * | 7/2002 | Schworer | 182/179.1 |
| 6,450,291 | B1 * | 9/2002 | Ono | 182/178.1 |
| 6,554,102 | B2 * | 4/2003 | Schworer | 182/179.1 |
| 2002/0036118 | A1 * | 3/2002 | Ono | 182/178.1 |
| 2003/0047382 | A1 * | 3/2003 | Panacci | 182/113 |
| 2003/0226714 | A1 * | 12/2003 | Masino | 182/119 |
| 2004/0200668 | A1 * | 10/2004 | Duplessis | 182/178.1 |
| 2004/0231922 | A1 * | 11/2004 | Schwoerer | 182/178.1 |
| 2007/0045048 | A1 * | 3/2007 | Wyse | 182/178.1 |

* cited by examiner

SCAFFOLD WITH HANDRAIL FRAMES PROVIDED WITH POST SECTIONS

BACKGROUND OF THE INVENTION

1. Field of the Invention

The invention relates to a scaffold comprising several spaced apart systems of construction frames present on top of each other, as well as handrail frames that extend between the construction frames and connect them together, which construction frames comprise at least two posts that are connected together by a crossbar, in which the rear of the scaffold is placed against a building and the handrail frames are at the front.

In assembling scaffolds it is desirable in the interest of safety to attach the handrail frame of the next floor by starting from the floor of the already assembled top floor and not first to attach the floor of the next floor and from there to attach the handrail frame of this new floor.

2. Prior Art

Such a scaffold is well known. In the well-known scaffold the handrail of a new floor is first connected mainly vertically to an end of an already erected post and then the other end lifted up using a further connected post, which is then attached to the already present post. This is a relatively difficult method of attaching a handrail of a new floor during the assembly of the scaffold without first putting the floor of this new floor in place.

SUMMARY OF THE INVENTION

An objective of the invention is to provide a scaffold of the type described in the preamble in which the attachment of a handrail of a new floor by starting from an already assembled floor is easy to achieve during the construction. For this purpose the scaffold according to the invention is characterised in that each handrail frame comprises two post sections, as well as a handrail that extends between the post sections and connects the post sections together, and in that the post at the front of each construction frame is shorter than the post at the rear. As the post sections between which the handrails extend are part of the handrail frames, the handrail frames can be easily attached to the short posts already present at the front of the construction frames.

The ends of the short posts can be provided with connecting pieces, which can be used to connect together two posts of adjacent handrail frames. A favourable embodiment of the scaffold according to the invention in which no specially shaped connecting pieces need to be present, is characterised in that the post sections of the handrail frames form parts of lengthwise divided posts.

The post sections of the handrail frame preferably have a transverse cross-section that is half that of a post present at the front of the construction frame.

An embodiment of the scaffold according to the invention is characterised in that each construction frame comprises a further post that is present between both posts and is as long as the post at the rear, in which several further horizontal crossbars, which extend between the posts and are spaced apart in the vertical direction, are present between both the long posts. This allows the floors at the rear half of the scaffold to be adjusted at any desired height.

In order to take a firm hold of the handrail frame, a further embodiment of the scaffold according to the invention is characterised in that each handrail frame comprises a side plank that extends between the post sections at the bottom of the handrail frame and connects them together. This side plank serves as a grip for positioning the handrail frame at a higher level.

A still further embodiment of the scaffold according to the invention is characterised in that the handrail and the side plank of the handrail frame comprise horizontal pipes that are provided with cord guiding rails, in which protective netting is attached on two edges of cords opposite each other. This allows the protection to be attached before the scaffold is put together.

Moreover, transparent panels are preferably present between two handrail frames present above each other.

A fence is preferably connected to the posts at the bottom front of the scaffold in order to prevent unauthorised persons from climbing onto the scaffold.

BRIEF DESCRIPTION OF THE DRAWINGS

The invention will be elucidated more fully below on the basis of drawings in which an embodiment of the scaffold according to the invention is shown. In these drawings.

DETAILED DESCRIPTION OF THE DRAWINGS

Figure 1:
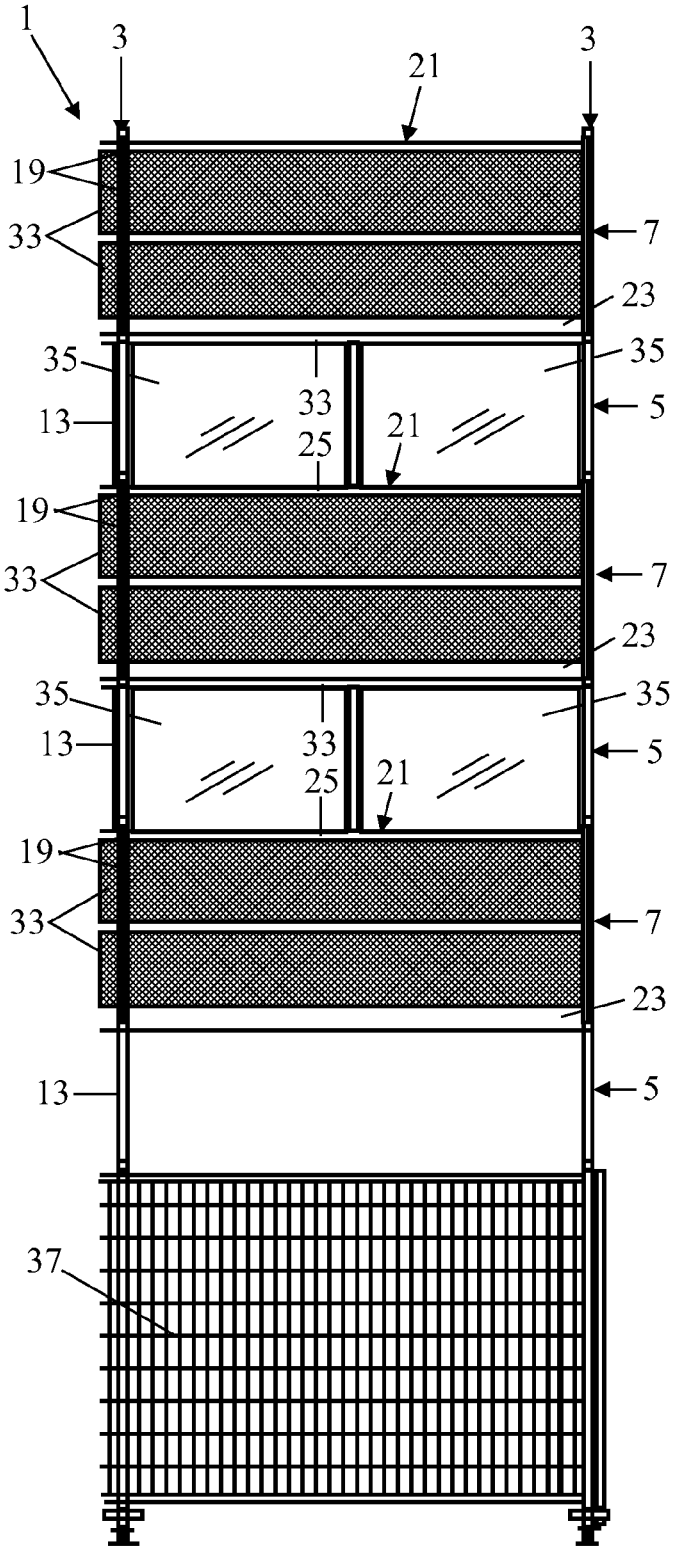
FIG. 1 shows a part of the scaffold in front elevation.
Figure 2:
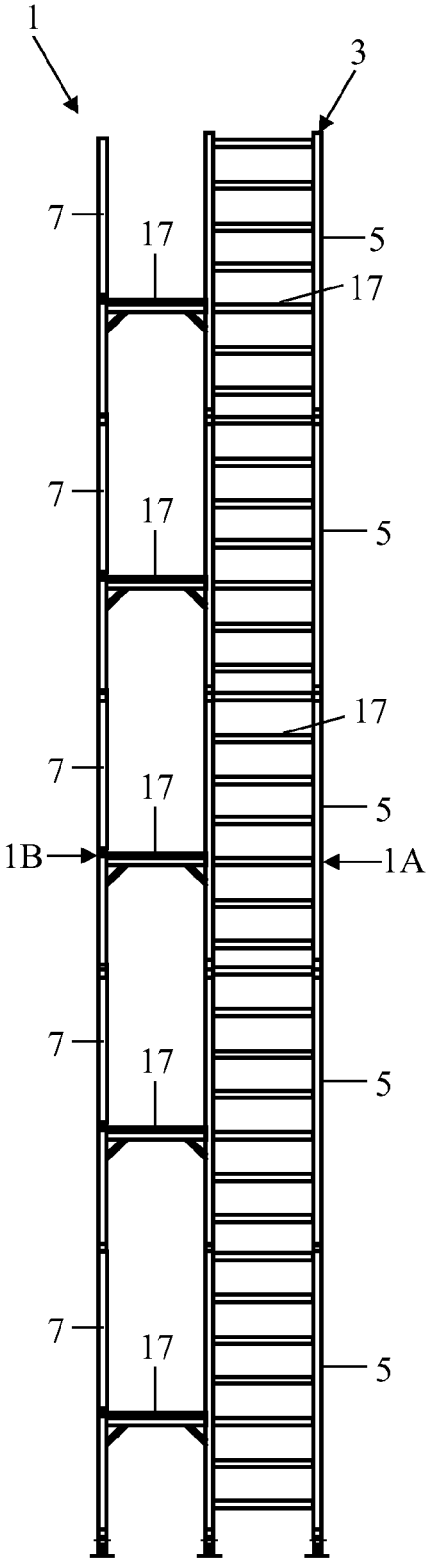
FIG. 2 shows a side elevation of the scaffold.

FIGS. 1 and 2 show an embodiment of the scaffold according to the invention from the front and side respectively. The scaffold 1 is built up of several spaced apart systems 3 of the construction frames 5 that are present on top of each other, as well as handrail frames 7 that extend between the construction frames and connect them together. The scaffold 1 has a rear 1A, with which it can be placed against a building. The handrail frames 7 are at the front 1B of the scaffold.

Figure 3:
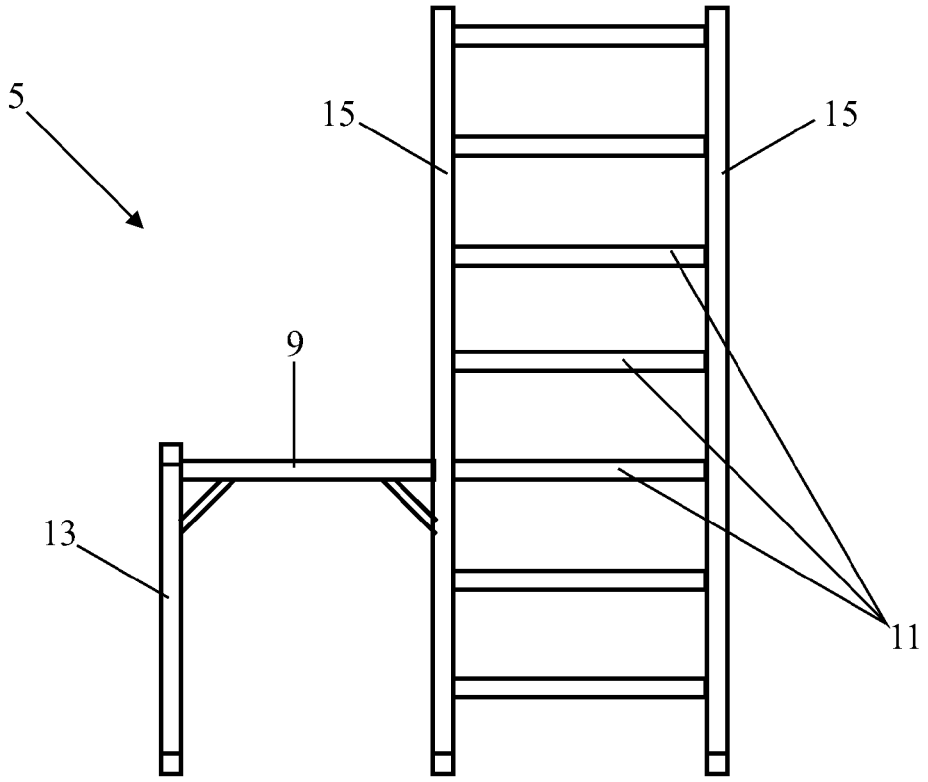
FIG. 3 shows a construction frame of the scaffold.

FIG. 3 shows a construction frame 5 of the scaffold. The construction frame has three posts 13, 15 connected together by crossbars 9 and 11, in which one of the outermost posts is shorter than the other two. This short post 13 is at the front of the scaffold and handrail frames are attached to it. The crossbars 9, 11 form supports for floor sections 17 (see FIG. 2) of the scaffold. A large number of horizontal crossbars 11 spaced apart in the vertical direction are present between both long posts 15. This allows a floor to be installed at the rear of the scaffold at any desired height.

Figure 4:
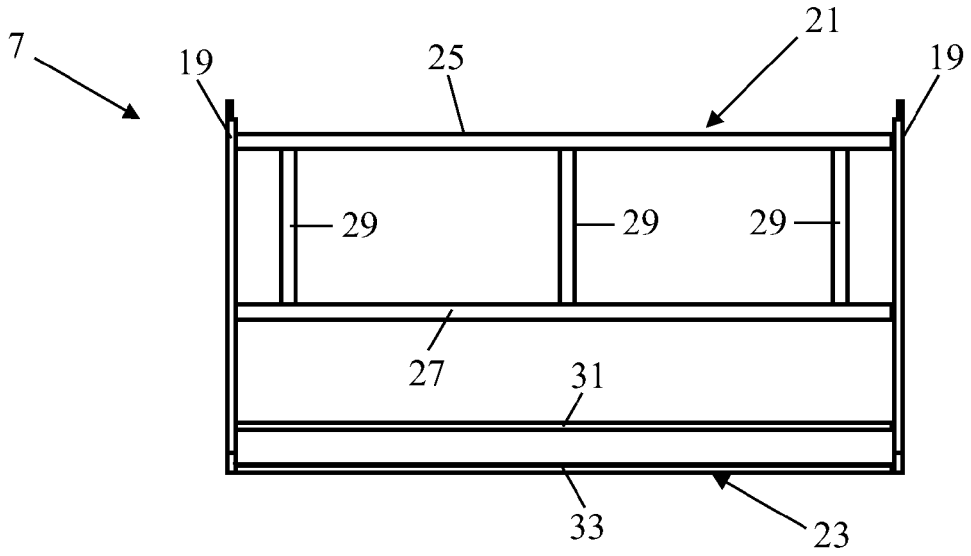
FIG. 4 shows a handrail frame of the scaffold.

FIG. 4 shows a handrail frame 7 of the scaffold. The handrail frame is built up of two post sections 19 at the top with a handrail 21 between them and a side plank 23 at the bottom. The post sections 19 form half of a lengthwise divided post and have a semi-circular cross-section. The post sections 19 of two adjacent handrail frames thus form one whole post, which can be inserted into the short post 13 of a construction frame 5, see FIG. 1. As the post sections 19 between which the handrails 21 extend are part of the handrail frames 7, the handrail frames can be easily attached to the short posts 13 of the construction frames already present at the front. This allows the side plank 23 to act as a grip so that the handrail frame can be easily grasped at the bottom.

The handrail 21 of the handrail frame 7, see FIG. 4, is built up of two horizontal pipes 25 and 27, which extend between the post sections, and vertical connecting rods 29, which extend between the pipes. The side plank 23 is also provided with horizontal pipes 31 and 33 at the bottom and top. The top pipe 31 of the side plank and the pipes 25 and 27 of the handrail are provided with cord guiding rails in which a protective netting 33 provided with cords is attached, see FIG. 1.

Transparent panels 35 are present between the top pipe 25 of the handrail of a handrail frame and the bottom pipe 33 of the side plank of a handrail frame above it.

A fence 37 is connected to the posts at the bottom front of the scaffold in order to prevent unauthorised persons from climbing onto the scaffold.

Although in the above the invention is explained on the basis of the drawings, it should be noted that the invention is in no way limited to the embodiment shown in the drawings. The invention also extends to all embodiments deviating from the embodiment shown in the drawings within the context defined by the claims.

What is claimed is:

1. Scaffold for use with a building, the scaffold comprising:

several spaced apart systems of construction frames present on top of each other, as well as handrail frames that extend between the construction frames and connect them together, which construction frames comprise at least a front post and a rear post that are connected together by a crossbar, the front and rear post and the crossbar being fixed to each and constitute one part, in which a rear of the scaffold is placed against the building and the handrail frames are at a front, characterised in that each of the handrail frames comprises two post sections, as well as a handrail that extends between the post sections and connects the post sections together; and wherein the front post of each construction frame is shorter than the rear post.

2. Scaffold according to claim 1, characterised in that the post sections of the handrail frames form parts of lengthwise divided posts.

3. Scaffold according to claim 2, characterised in that the post sections of the handrail frame have a transverse cross-section that is half that of the front post of the construction frame.

4. Scaffold according to claim 1, characterised in that each construction frame comprises a further post that is present between the front and rear posts and is just as long as the rear post, and further comprising several further horizontal cross-bars, which extend between the rear post and the further post and are spaced apart in the vertical direction.

5. Scaffold according to claim 1, characterised in that each handrail frame further comprises a side plank that extends between the post sections at a bottom of the handrail frame and connects them together.

6. Scaffold according to claim 5, characterised in that the handrail and the side plank of the handrail frame comprise horizontal pipes, which are provided with cord guiding rails in which protective netting provided with cords is attached between two opposite edges.

7. Scaffold according to claim 1, characterised in that transparent panels are present between two handrail frames present above each other.

8. Scaffold according to claim 1, characterised in that a fence is connected to the front posts at a bottom of the scaffold.

9. A scaffold for use with a building, the scaffold comprising:

several spaced apart construction frames present on top of each other, each construction frame having at least a front post and a rear post, that are connected together by a crossbar;

handrail frames that extend between the construction frames and connect them together, wherein each handrail frame comprises two post sections and a handrail that extends between the post sections and connects the post sections together;

wherein a rear of the scaffold is adapted to be placed against the building such that the handrail frames are positioned at the front; and wherein the front post of the construction frame is shorter than the rear post.

* * * * *